US006245395B1

(12) United States Patent
Falat et al.

(10) Patent No.: US 6,245,395 B1
(45) Date of Patent: Jun. 12, 2001

(54) PACKAGING MATERIAL HAVING GOOD MOISTURE BARRIER PROPERTIES FROM C1S PAPERBOARD

(75) Inventors: Ladislav Falat, Columbia; Mohan Sasthav, Elkridge, both of MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/465,310

(22) Filed: Dec. 17, 1999

Related U.S. Application Data

(63) Continuation of application No. 09/032,914, filed on Mar. 2, 1998.

(51) Int. Cl.[7] ..... B05D 3/06

(52) U.S. Cl. ..... 427/557; 427/558; 427/204; 427/210; 427/288

(58) Field of Search ..... 427/557, 558, 427/204, 210, 288; 493/56, 110, 148, 328

(56) References Cited

U.S. PATENT DOCUMENTS

| | | | | |
|---|---|---|---|---|
| 1,908,275 | | 5/1933 | Youngchild et al. . | |
| 1,937,317 | | 11/1933 | Codwise | 92/40 |
| 2,291,616 | | 8/1942 | Fletcher | 92/40 |
| 2,443,222 | | 6/1948 | Bergstein | 117/60 |
| 3,136,652 | * | 6/1964 | Bicknell | 117/60 |
| 4,554,215 | * | 11/1985 | Robbart | 428/447 |
| 5,032,225 | * | 7/1991 | Saji et al. | 162/135 |
| 5,418,008 | * | 5/1995 | Calvert | 427/203 |
| 5,935,664 | * | 8/1999 | Claytor et al. | 428/34.2 |
| 6,029,582 | * | 2/2000 | Ogilvie, Jr. et al. | 108/51.3 |

* cited by examiner

*Primary Examiner*—Shrive Beck
*Assistant Examiner*—Jennifer Kolb

(57) ABSTRACT

The preparation of packaging material having good moisture barrier properties from a C1S paperboard substrate in a single pass on a printing press is improved by preheating the substrate before application of the moisture barrier coating to the uncoated surface of the substrate. Preheating the substrate improves coating holdout, reduces pinholes and permits the application of a thin film of coating to achieve the desired result.

4 Claims, No Drawings

PACKAGING MATERIAL HAVING GOOD MOISTURE BARRIER PROPERTIES FROM C1S PAPERBOARD

This application is a Continuation of U.S. application Ser. No. 09/032,914, filed Mar. 2, 1998.

BACKGROUND OF INVENTION

The present invention relates generally to packaging and packaging materials, and more particularly to a packaging material for food products wherein the packaging material comprises a paperboard substrate having a first surface to which there has been applied a coating suitable for printing high quality graphics. Such substrates are known in the art as coated-one-side or C1S paperboard substrates. The invention further relates to the application of a barrier material to the opposite or uncoated surface of such substrates which is resistant to the penetration of moisture and moisture vapor. Compositionally, coatings useful for printing high quality graphics generally include a fluidized blend of minerals such as coating clay, calcium carbonate, and/or titanium dioxide with a suitable binder such as starch, polyvinyl alcohol, polystyrene or the like. These coatings are generally applied to paperboard substrates on a papermachine during the papermaking process by typical coating devices such as roll, rod, air knife or blade coaters. Successive densification and polishing of the coated surface by calendering finishes the surface to a high degree of smoothness and gloss to achieve a superior surface for high quality printing.

Meanwhile, barrier materials for application to the opposite surface of C1S paperboard substrates, for protecting the substrates from moisture or the penetration of moisture vapor include extrudable resins such as low density polyethylene (LDPE), polypropylene (PP) and polyethylene terephthalate (PET). However, the use of extrudable resins for the intended purpose must be done in a separate process, that is generally remote from the papermachine, which entails increased costs and handling. Moreover, the use of extruded resins for moisture vapor barrier protection generally requires a thick film to achieve the desired results. Suitable and effective moisture barrier protection can be achieved for C1S paperboard substrates with the use of coatings prepared from emulsions such as acrylics, ethylene vinyl chloride (EVCL), polyvinylidene chloride (PVDC) and PET. Such coatings can be applied in a uniform and continuous film using the same coating devices used on a papermachine such as roll, rod, air knife or blade coaters, however the application of such coatings on a papermachine is generally not done because of the high costs associated with small orders, and the high speed of papermachines.

In order to overcome these and other problems, the method disclosed in U.S. Pat. No. 5,418,008 was developed. According to the teachings of the '008 patent, a paperboard substrate which has been previously coated on one or both surfaces is applied with a continuous film of a barrier material, at a low coat weight, in a single pass, on a printing press, at the same time that the substrate is printed and converted into blanks for forming packages. Unfortunately the practice of the invention disclosed in the '008 patent, which is assigned to the present assignee herein, has been discouraging due to poor coating holdout, drying problems and high coating consumption, particularly with the use of C1S paperboard substrates. Accordingly, the present invention was designed to improve upon and overcome any problems with the practice of the invention disclosed in the '008 patent.

SUMMARY OF INVENTION

U.S. Pat. No. 5,418,008 discloses a method for making barrier packaging material for food products using as a substrate clay coated paperboard, both C1S and C2S (coated two sides). Not surprisingly, the preferred substrate is C2S paperboard since, the amount of barrier material needed to achieve adequate barrier properties is less with C2S paperboard than with C1S paperboard. Unfortunately, C2S paperboard is more costly than C1S paperboard. Nevertheless, despite the cost disadvantage, the use of C1S paperboard as a substrate has all but been abandoned because of the disparity in the amount of barrier material needed to achieve adequate barrier properties for C1S versus C2S paperboard.

Now, however, according to the present invention, it has been discovered that it is possible to use C1S paper-board as a substrate, and achieve substantially the same barrier properties available with a C2S substrate, at about the same coat weight of barrier material normally used on a C2S substrate. This improvement is achieved by preheating the C1S substrate prior to the application of the barrier coating. This step permits the economical production of a barrier packaging material for food products using the less costly substrate, C1S paperboard. By preheating the C1S substrate prior to applying the barrier coating, significantly fewer pin holes are produced in the coated film. While the mechanism of the present invention is not completely understood, it is speculated that one possibility for the improved performance may be that the preheating step produces a substantially dry surface for the coating, and dry fibers are more difficult to wet than fibers with higher moisture content. Another possibility is that preheating the substrate causes the barrier coating to flash-dry at the surface upon application, which forms a thin film that does not allow the coating to penetrate any further into the substrate. A third possibility, that might also explain the reduction in pinholing, is that preheating causes the viscosity of the coating to be altered at the interphase between the coating and paperboard which allows the-coating to flow more easily. In any event, despite the fact that the effects of treating a paper or paperboard web before coating is well documented in the prior art, none of the prior art teaches the discovery disclosed herein.

For example in U.S. Pat. No. 1,908,275, a process is disclosed for coating paper with oil wherein the paper web is exposed to live steam just before the oiling step to achieve a product of more uniform quality; meanwhile in U.S. Pat. No. 1,937,317, the tendency for sizing material to be absorbed into the inner structure of a paper web which is warm after passing over drying rolls is overcome by calendering the web before applying the sizing; in U.S. Pat. No. 2,291,616, the surface of a hot paper web is premoistened before the application of a coating to prevent penetration of the coating material into the fibers of the web; likewise in U.S. Pat. No. 2,443,222, the concept of wetting the surface of a fibrous web using a light spray of water, immediately before a coating of a molten wax is applied, is taught to lessen or eliminate altogether the penetration of the wax into the fibrous sheet stock; in U.S. Pat. No. 3,136,652, a cooling roll is employed on a paper-machine to reduce the temperature of a paper web from about 150 degrees F. to below 110 degrees F. (and preferably below 80 degrees F.), before a coating is applied; in U.S. Pat. No. 4,554,215, the paper web is treated with vapors of silanes prior to coating to impart needed hold out, wet strength, release and other characteristics to the substrate; and in U.S. Pat. No. 5,032,225, which discloses the application of a coating to a web on a papermachine, the temperature of the web is adjusted (reduced) immediately prior to being coated since if coated at the normal web temperatures experienced on a papermachine (50–70 degrees C.), the coating composition has a tendency to rapidly penetrate into the paper web because the surface tension and viscosity are reduced.

Contrary to the prior art teachings described above, it has been found advantageous according to the present invention to preheat a paper web, in particular a C1S paperboard web, before a barrier material, for example an emulsion of PVDC, EVCL, PET or an acrylic resin, prepared as an aqueous coating, is applied to the uncoated surface of the web. The web may be heated by any suitable means including infrared (IR), flame, microwave or contact with a heated drum. The preheat treatment should be sufficient to reach a web surface temperature of from about 120 to 160 degrees F., and preferably 140 degrees F.

DETAILED DESCRIPTION

The method of the present invention has been established in accordance with the following Example. It will be understood that the Example is illustrative only, and should not present any limitation on the practice of the invention, since it will be understood that variations and modifications can be made in the invention substantially within the scope of the appended claims.

EXAMPLE

Samples of a C1S substrate (heated and unheated) were coated with a styrene acrylate emulsion barrier coating. A No. 10 coating rod was used on a printing press. The C1S substrate picked up approximately 2 lbs/MSF (1,000 sq. ft), of coating in each case. The unheated sample was observed to have a substantial number of pinholes and a MVTR (moisture vapor transmission rate) greater than 25 gr/100 $in^2$/day. However, after heating the C1S substrate to about 135 degrees F., the MVTR was reduced to about 12.2 gr/100 $in^2$/day. Similar coating applications to a C2S substrate before and after heating (approximately 1.3 lb/MSF coating applied in each case), yielded MVTR's of 23.6 for the unheated sample and 20.6 for the heated sample. It will thus be seen that the heated C1S substrate produced the lowest MVTR. While the slightly higher coat weight applied to the heated C1S sample offers some explanation for the lower MVTR, it is important to note that the lowest MVTR was achieved with the lowest cost substrate, thus providing the most cost effective barrier structure.

What is claimed is:

1. Method for improving the moisture barrier properties of coated one side paperboard packaging material prepared in a single pass on a printing press, comprising the steps:

a) selecting a paperboard substrate having a coating of particulate minerals on one surface thereof;

b) printing sales graphics on the coated surface of said substrate;

c) preheating the surface of said substrate that is opposite to coated surface; and, d) coating the preheated surface of said paperboard substrate with an aqueous emulsion of a moisture barrier material selected from the group consisting of PVDC, EVCL, PET and acrylic resin; wherein the preheating of step (c) significantly reduces the number of pinholes in the pre-heated, coated substrate and thereby provides said substrate with improved moisture barrier properties in comparison to an unheated, coated substrate.

2. The method of claim 1 wherein the coat weight of moisture barrier material applied to the substrate is within the range of from about 1 to 12 lbs/ream (ream size 3000 $ft^2$).

3. The method of claim 2 wherein the substrate is preheated to a temperature in the range of from about 120 to 160 degrees F.

4. The method of claim 3 wherein the preheat treatment is selected from the group consisting of IR, flame, microwave and contact heating.

* * * * *